United States Patent [19]

Morton

[11] 4,358,758

[45] Nov. 9, 1982

[54] DOOR LOCKING ALARM DEVICE

[76] Inventor: David C. Morton, 3152 Curtis Dr., Flint, Mich. 48507

[21] Appl. No.: 244,294

[22] Filed: Mar. 16, 1981

[51] Int. Cl.[3] ..... G08B 13/08

[52] U.S. Cl. ..... 340/546; 340/686; 292/339; 200/61.93

[58] Field of Search ..... 340/546, 545, 686; 292/338, 339; 200/61.93, 61.62

[56] References Cited

U.S. PATENT DOCUMENTS

| | | | |
|---|---|---|---|
| 1,695,686 | 12/1928 | Hess | 390/545 |
| 2,870,281 | 1/1959 | Mitchell | 292/339 |
| 4,036,518 | 7/1977 | Jost | 292/339 |
| 4,139,845 | 2/1979 | Washburn | 340/686 |

*Primary Examiner*—Glen R. Swann, III

*Attorney, Agent, or Firm*—Harry R. Dumont

[57] ABSTRACT

A combination door lock and alarm has an upper end clip engageable with the door handle, a shaft extending in an adjustable length tube and terminating in a non-skid rubber end adapted to engage the floor or carpet. The clip at the upper end of the shaft is angularly mounted and has its lower end lying in a plane substantially aligned with the longitudinal axis of the shaft. An alarm device is also mounted on the shaft and includes an actuator for it with a switch contact normally abutting or close to abutment with the surface of the door at a point below the door handle. Responsive to inward movement and pressure on the door the alarm will be actuated. At the same time, the locking action of the shaft and clip will divert the opening inward forces into forces directed against the floor so that the door cannot be opened.

8 Claims, 7 Drawing Figures

DOOR LOCKING ALARM DEVICE

BACKGROUND OF THE INVENTION

The present invention relates to a door locking device that is easily portable and adjustable in length to protect a wide variety of door openings. The door locking device further includes an alarm built integrally with it and having its own power source so that the alarm can be readily installed at the same time and concommitantly with the installation of the door locking device. A problem exists with respect to single door entry units such as hotels and motels in which a number of keys may be available to third parties other than management. Also in a number of cases the doors and the door locks installed by themselves are deficient in providing very little resistance to heavy entry pressure. For example the average door frame may provide only an $\frac{1}{8}''$ or $\frac{1}{4}''$ of wood frame resisting inward pushing pressure on the door in its locked condition.

The present invention is adapted to firmly and very strongly resist inward opening pressure on the door. Inward pressure is diverted into a pressure against the floor and it has been found in practice that, before the door can be fully opened with a locking device according to the present invention, it would be necessary to force the door itself off its hinges.

An important feature of the present invention is the incorporation in it of an alarm device which will be operated after limited movement of the door and independently of the locking action. Thus the person who has installed the portable alarm on his door is given an alarm that someone is seeking entry long before the door has been far moved.

The present invention is particularly important since it is adapted to engage existing parts of the door, namely the door handle and to operate directly on the flooring material whether it be carpet, rug or tile.

A number of prior art devices are known which are designed to lock doors against entry. These generally involve complicated arrangements and permanent installations of the locking device with respect to the door and to the floor.

U.S. Pat. No. 1,695,686 issued on Dec. 18, 1928 to S. P. Hess for "Door Secure" shows one such type of door securer. It will be seen that the alarm device is separately mounted and installed in the door and it requires a relatively complicated arrangement and is certainly not portable. The securing device itself requires a declivity in the floor and permanent installation on the inner surface of the door. The present invention overcomes these major disadvantages and provides a single portable unit operable both to secure the door and to give the necessary alarm.

U.S. Pat. No. 2,870,281 issued on Jan. 20, 1959 to F. E. Mitchell for "Burglar Alarm" shows another type of burglar alarm including a locking device with alarm. The alarm however is a telescoping alarm and it requires substantial movement of the door and locking device before there is provided an audible alarm. Also it will be seen that the primary and indeed only operative object of the device is to give an alarm. Ther is not provided the resistance required to aford concommitant locking against the door opening. Also the arrangements shown in this patent is far less portable and adaptable to moving or installation in any available housing unit.

A still further alarm apparatus operable along with a door is shown and described in U.S. Pat. No. 4,139,845 issued on Feb. 13, 1979 to A. F. Washburn. This patent discloses a tip-over type alarm adapted to be in contact with a closed door and to be tipped over by attempted entry. The device is a dual type device being both an alarm and a flashlight. It does not however during its operation as an alarm also give a secure resistance against opening of the door as does the present invention.

BRIEF SUMMARY OF THE INVENTION

The present invention will be seen to be a combined door locking and alarm device in which the two functions are performed by a relatively simple arrangement of parts. The device includes an adjustable length shaft having the alarm at its upper end and a non-skid lower end adapted to abut against the floor. A rigid clip is firmly attached to the upper end of the shaft so that as the door is opened the forces inward are translated into forces directed into the floor and there is thus an extremely strong resistance given to inward movement of the door.

BRIEF DESCRIPTION OF THE DRAWINGS

The present invention will be described in conjunction with the accompanying specification and with reference to the drawings in which like numerals are used to identify like elements as they may appear throughout the several drawing figures and in which.

DETAILED DESCRIPTION OF THE PREFERRED EMBODIMENT

Figure 1:
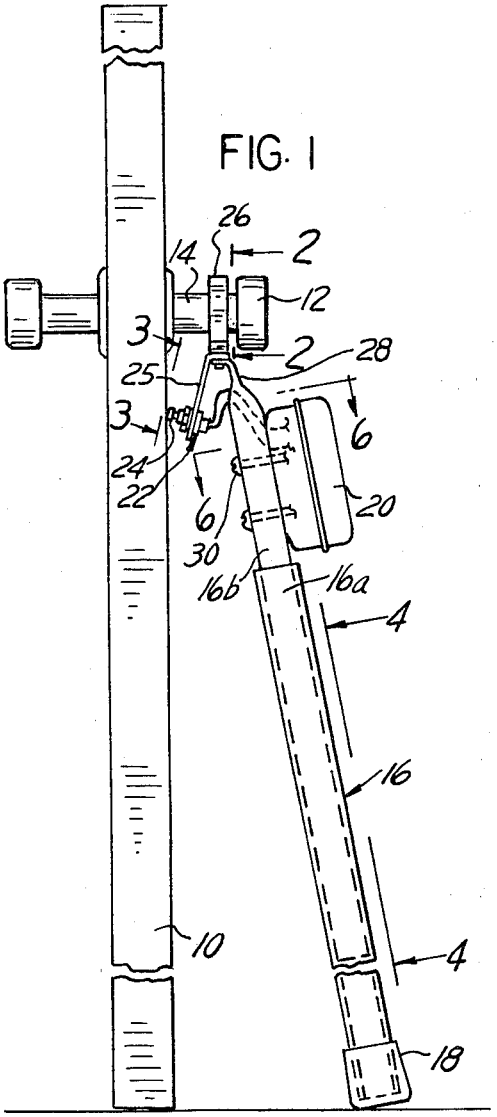
FIG. 1 is a side elevational view of a door and of the locking device with parts broken away.

FIG. 1 shows a door 10 in its closed position. The door 10 includes a conventional knob 12 connected to the central lock mechanism by a shaft 14. The locking and alarm device according to the present invention is indicated generally by the numeral 16. The locking device 16 is of a tubular type having an inner and outer sliding member with the numeral **16*a* for the external member and the numeral 16*b* indicating the internal slider. A non-skid end 18 is attached to the lower end of the locking device 16** to prevent its sliding movement across the floor when the door is opened.

There are several elements connected to the upper end of the shaft of locking device 16 which include an audible electrically operated alarm 20 of a type well known and commonly used and having a DC source incorporated with it for operation. In the interest of simplification and brevity, the details of the alarm device 20 are not given. An electrical operating switch 22 is fixed to the upper end of the sliding tube **16*b*. The switch 22 includes an actuator in the form of a movable contact 24 bearing against the inner surface of the door 10. Responsive to the closure of the normally open contact 24 there will be given an audible output from the alarm device 20. It will be seen that a very small amount of movement will be allowed for the door 10** prior to there being an alarm given.

A locking clip 26 is also mounted at the upper end of the tube **16*b*. The lower end of the locking clip 26 is securely attached to the tube 16*b* transaxial but almost parallel to the tube at a point denoted by the numeral 28. It will be seen that the clip 26 has an angular orientation with respect to the doorknob shaft 14 and the longitudinal axis of the tube 16*b* such that inward forces against the clip 26 are translated into a downward vector of force and cause movement of the locking device shaft 16 into the floor. This affords tremendous resistance to the swinging movement of the door 10. Tests have indicated that the door must be pushed off its hinges before the locking device shaft 16 will be moved along the floor or broken. Also shown in FIG. 1 are a plurality of fasteners 30 used to attach the alarm device 20 to the upper end of the tube 16*b*. It is important that the shaft 16 be adjustable in length since all doors are not uniform with respect to the height of their doorknob above the floor. Also in some cases, where the floor is relatively slippery it may be required to have a slightly different angle of the clip 26 to shaft 16** connection.

Figure 2:
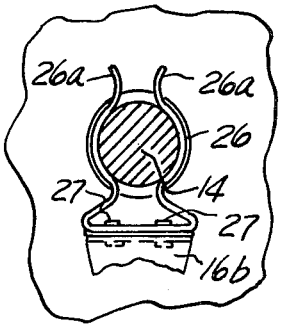
FIG. 2 is a cross-sectional view of the handle taken along the lines 2—2 of FIG. 1 to show the parts of the locking device clip.

FIG. 2 shows the manner in which the clip 26 includes an open ended pair of resilient ends **26*a* which are fitted around the doorknob shaft 14 when the device is installed. Also shown are a pair of threaded fasteners 27 used to attach the clip to the upper end of the tube 16*b***. It will be understood that other fasteners such as rivits may be used for this purpose.

Figure 3:
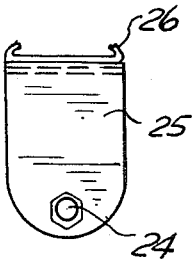
FIG. 3 is a view taken along the section lines 3—3 of FIG. 1 showing the actuator for the alarm.

FIG. 3 illustrates the manner in which the movable contact 24 extends inwardly in the direction of the inner surface of the door 10. It is supported in a downwardly extending bracket 25 which preferably is attached to the lower surface of the locking clip 26. It will be understood that different types of alarms may be used in place of the audible alarm 20 such as a blinking light and audible alarm, all of which are electrically actuated in a manner well known in the art.

Figure 4:
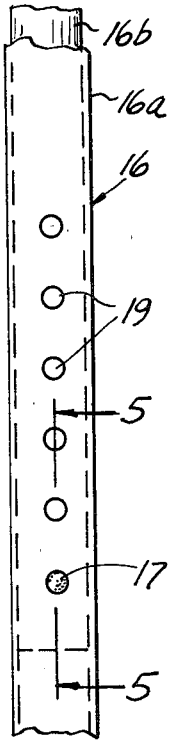
FIG. 4 is a view taken along the lines 4—4 of FIG. 1 showing a length of the adjustable length shaft.
Figure 5:
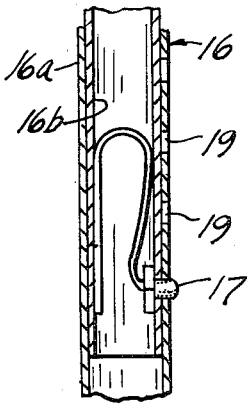
FIG. 5 is a cross-sectional view taken along the lines 5—5 of FIG. 4 showing the engaging element of the adjustable length shaft.

FIGS. 4 and 5 show the manner in which the two sliding tubes **16*b* and 16*a* are telescopically adjusted to size the length of the alarm device shaft. For this purpose a resiliently mounted plunger 17 is included and mounted on the inner surface of the sliding tube 16*b*. The plunger 17 is adapted to protrude in locking arrangement through a selected one of a plurality of spaced openings 19 along the length of the outer tube 16*a*. Thus the length may be adjusted by simply depressing the plunger 17 and moving the two tubes one relative to the other until the correct length and opening 19** is selected.

Figure 6:
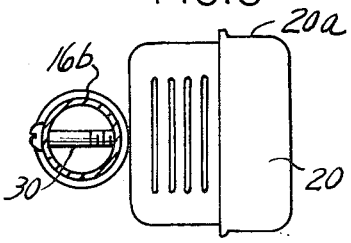
FIG. 6 is a cross-sectional view taken along the section line 6—6 of FIG. 1 showing the basic alarm device and the manner in which it is attached to the upper end of the shaft of the alarm device.

FIG. 6 shows the manner in which the casing **20*a* for the alarm 20 is fixed to the upper end of the tube 16*b* by a pair of threaded fasteners 30**. It is important with respect to the present invention that the device be light, compact and easily installable where desired. This makes it useful to travelers and well as to people using it in their own personal residence.

It will also be understood that it is possible to mount the alarm device by providing a swivel end mounting arrangement between the lower end of the clip 26 and the upper end of the tube **16*b*** in such manner that the locking device can be swung out of operative position and yet left installed on the door when this arrangement is appropriate.

Figure 7:
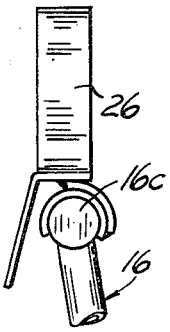
FIG. 7 is a fragmentary view of an alternate embodiment of the alarm device.

FIG. 7 shows a modified ball joint **16*c*** coupled between the clip and tube to permit this mode of operation.

It will thus be seen that I have provided by my invention a combined door locking and alarm device which combines and performs the two functions in a simple, straightforward and reliable manner and with a novel arrangement of parts unknown to the prior art.

I claim:

1. A door locking and alarm device for portable use and ready installation on a door handle comprising:

an adjustable length shaft portion;

a non-skid end portion mounted on the lower end of the shaft portion;

a door handle engaging clip fixed to the upper end of said shaft portion and mounted on it substantially aligned to its longitudinal axis; and an alarm device mounted on said shaft portion and having an actuator therefor in abutment with the inner surface to the door when the device is in use for providing an alarm responsive to a limited movement of the door inwardly.

2. The combination as set forth in claim 1 wherein said adjustable length shaft portion includes inner and outer telescoping sleeve portions and a plunger adjustably registerable with one of a plurality of holes longitudinally arranged in said outer sleeve portion.

3. The combination as set forth in claim 1 wherein said alarm device is of the electrically operated, audible type and said actuator comprises a movable contact mounted proximate the upper end of said shaft and normally in engagement with the inner surface of the door.

4. The combination as set forth in claim 1 wherein a swiveling mounting means is included intermediate said clip and the upper end of said shaft to permit its being pivoted and stored in an inactive position against the inner door surface.

5. The combination as set forth in claim 1 wherein said alarm device is of the electrically operable type having its own electrical power source included.

6. The combination as set forth in claim 5 wherein said alarm device actuator comprises a normally open contact and switch.

7. The combination as set forth in claim 1 wherein said clip is operable to engage the shaft associated with a knob of said handle.

8. A door locking device for portable use and ready installation on a door knob and door knob shaft, comprising:

an adjustable length shaft portion;

a nonskid end portion mounted on the lower end of said shaft portion;

a rigid clip having resilient free end portions engagable about said door knob shaft;

said clip having a base portion connected to the upper end of said shaft portion and in substantial alignment with the longitudinal axis of said shaft, said clip base portion pivotally connected to the upper end of said shaft portion to allow storage of said device against the door surface in an inactive position.

* * * * *